US011325273B1

(12) United States Patent
Insana et al.

(10) Patent No.: US 11,325,273 B1
(45) Date of Patent: May 10, 2022

(54) ADJUSTABLE HEAD RAZOR

(71) Applicant: Blazor, LLC, Cleveland, OH (US)

(72) Inventors: P. J. Insana, Naples, FL (US); John Hollis, Cleveland, OH (US); Gabriel Puerto, Cleveland, OH (US); Mike Tracz, Cleveland, OH (US); Joe Spalding, Cleveland, OH (US); Jason Kocher, Mentor, OH (US); Jon Morgan, Cleveland, OH (US); Monica Schnee, Cleveland, OH (US); Amy Hawk, Cleveland, OH (US)

( * ) Notice: Subject to any disclaimer, the term of this patent is extended or adjusted under 35 U.S.C. 154(b) by 63 days.

(21) Appl. No.: 16/994,560

(22) Filed: Aug. 15, 2020

Related U.S. Application Data

(60) Provisional application No. 62/961,870, filed on Jan. 16, 2020.

(51) Int. Cl.
*B26B 21/52* (2006.01)
*B26B 21/40* (2006.01)
*B26B 21/22* (2006.01)

(52) U.S. Cl.
CPC ..... *B26B 21/521* (2013.01); *B26B 21/225* (2013.01); *B26B 21/4062* (2013.01)

(58) Field of Classification Search
CPC . B26B 21/521; B26B 21/225; B26B 21/4062; B26B 21/40; B26B 21/523
USPC ..... 30/47–52
See application file for complete search history.

(56) References Cited

U.S. PATENT DOCUMENTS 3,685,150 A * 8/1972 Risher ..... B26B 21/18 30/74.1
3,950,848 A * 4/1976 Goldstein ..... B26B 21/225 30/47
4,392,303 A * 7/1983 Ciaffone ..... B26B 21/521 30/526

* cited by examiner

*Primary Examiner* — Evan H Macfarlane
*Assistant Examiner* — Liang Dong
(74) *Attorney, Agent, or Firm* — Gugliotta & Gugliotta LPA

(57) ABSTRACT

A safety razor is provided having a blade head capable of having an adjustable angle relative to a grasping handle and an adjustability of tension of a pivot to the blade. The blade head is connected by an adjustment mechanism for adjusting the blade head that is substantially enclosed within a conduit formed within the grasping handle. The blade head is angularly adjustable between an angle >95° from a linear centerline of the handle to about 22° from the linear centerline of the handle. A blade head adapter may be further provided to allow for attachment and use of alternate existing blade head cartridges.

9 Claims, 2 Drawing Sheets

ADJUSTABLE HEAD RAZOR

RELATED APPLICATIONS

The present application claims the benefit of U.S. Provisional Application Ser. No. 62/961,870, filed on Jan. 16, 2020 and incorporated by reference as if fully rewritten herein.

BACKGROUND OF THE INVENTION

1. Field of the Invention

The present invention relates to safety razor systems and, more particularly, to a shaving razor having an adjustable angle shaving head that can be effectively utilized at various shaving angles.

2. Description of the Related Art

A safety razor is a shaving implement with a protective device positioned between the edge of the blade and the skin. The initial purpose of these protective devices was to reduce the level of skill needed for injury-free shaving, thereby reducing the reliance on professional barbers. Since their introduction in the 1970s, cartridge razors and disposable razors (i.e., where the blades are embedded in plastic) have become the predominant types of safety razors.

Safety and disposable razors are fields in which continuous innovation and improvement exists. However, one general field of innovation tends toward improvements directed to gender-specific shaving requirements. For example, men's shaving needs are substantially directed toward shaving the face and, to a lesser extent the head, while women's shaving needs are directed substantially toward shaving of the legs. When used with different body surfaces, differences in shaving approaches may be beneficial. Differences in an angle between blades and the shaving surfaces, as well as differences in the movement or return of a shaving head can result in improved shaving results depending upon the body surface to be shaved, the direction from which the razor is manipulated, and other conditions such as whether a user is shaving about the sagittal plane or coronal plane.

Some methods and improvements are known that incorporate various mechanisms for affecting the shaving head of a safety razor. For example:

U.S. Pat. No. 3,389,467, issued in the name of Baumann, discloses a shearing head for electric razors with a cutter block reciprocated by a rocking lever and pressed by a spring toward the inner face of a shearing comb sheet.

U.S. Pat. No. 4,501,066, issued in the name of Sceberras, discloses a dual headed razor system having a handle supporting a pair of separately detachable razor heads respectively useful in shaving forwardly and rearwardly in to and fro strokes. The identical razor heads are usable interchangeably and are telescopically supported crosswise of the handle.

U.S. Pat. No. 4,989,328, issued in the name of Sokoloff, discloses dual razor heads mounted on a single handle. One razor head is adapted to hold a conventional size blade. The other razor head is adapted to hold a much smaller blade for convenient shaving around one's nostrils and for trimming of moustaches, beards and sideburns. The user can choose between either razor head simply by rotating the handle with his fingers.

U.S. Pat. No. 6,141,875, issued in the name of Andrews, discloses in-line razor-blade shaving devices feature two sets of razor blade strips pointing outwardly in opposite directions. The devices are designed for safely and rapidly shaving hair from large body portions such as legs and arms. Each device features an elongated handle arranged in line with an elongated bidirectional razor blade head. Each set of razor blade strips in the head may be provided with one or more straight razor-sharp edges, which point in the same direction, while the blade edges of the two sets point outwardly away from one another, generally in opposite directions. The edges of blade strips of the two sets may be arranged in one common working plane, or each set may be in its own working plane, with the planes at an angle to one another. The bidirectional head may be constructed in a variety of ways, including in a molded form, in an assembled form, as a replaceable bidirectional cartridge, and as two separate unidirectional razor blade heads arranged in close proximity to one another. These in-line bidirectional razor blade shaving devices represent a new family of wet shaving razor devices.

U.S. Pat. No. 6,560,876, issued in the name of Carr, discloses a dual headed razor with a handle with a shaving razor head at each of opposite ends of the razor handle.

U.S. Patent Application Publication 2003/0097755, published in the name of Singh, discloses a bidirectional instrument for shaving or cutting hair having a safety razor having a head holding a conventional interchangeable blade system. A first friction pivot at the head to a first end of a first handle, and a second friction pivot at a second end of the first handle opposite the first end to one end of a second handle. The razor is characterized in that, with the second handle as a handle for holding the razor in use, the head may be both angled and offset relative to the second handle. The first handle is preferably implemented with a fixed angle of from fifteen to ninety degrees, preferably about forty-five degrees.

U.S. Patent Application Publication 2003/0182802, published in the name of Vega et al., discloses V-shaped razor head and blades including a v-shaped head, a plurality of v-shaped blades and a handle. The left and right sides of the v-shaped blades meet at approximately one-hundred and twenty degrees. The bottom of the v-shaped blade is rounded. When configured in a package, the bottom of one v-shaped head fits within a valley defined by another v-shaped head.

U.S. Patent Application Publication 2007/0283567, published in the name of Magli, discloses a dual headed razor including a first razor blade assembly for shaving a user's face, or other desired area, in a conventional manner, along with a second razor blade assembly for trimming restricted areas, such as unwanted hair between the user's eyebrows, shaping a goatee or moustache, or trimming sideburns. The first and second razor blade assemblies are respectively mounted to first and second blade supports, which are respectively mounted to an upper end of a handle. The second blade support projects rearward from the handle 180° opposite the first blade support and is positioned above the first razor blade assembly. The second razor blade assembly has a width less than that of the first razor blade assembly.

U.S. Patent Application Publication 2009/0071011, published in the name of Macove, discloses a razor system for shaving facial and body hair. The razor system has a handle and a razor cartridge. The razor cartridge has a primary group of blades and a second group of blades, such that the primary group of blades makes a first common plane and the second group of blades makes a second working plane. The first common plane and the second working plane are directionally-opposed. The present invention further relates to a method of shaving with the razor system.

U.S. Patent Application Publication 2014/0068948, published in the name of Marder, discloses a multi-headed razor device that may be used to shave a surface area not covered by an individual razor. The device may include a handle body having a first end, a plurality of handle arms having a first end and a second end attached to the handle body, a plurality of razor heads attached to the first end of the handle body and the first end of the plurality of handle arms. A plurality of release buttons may be attached to the first end of the handle body and the first end of the plurality of handle arms to release the plurality of razor heads. A plurality of buttons may be attached to a top portion of the handle body to release the plurality of handle arms.

U.S. Patent Application Publication 2014/0259679, published in the name of Tracy, discloses a multi-headed safety razor including a handle and a shaving head. The shaving head defines a longitudinal axis. The shaving head is mounted to a distal portion of the handle and has a rest position. The shaving head is configured to rotate out of the rest position in a first radial direction transverse to the longitudinal axis defined by the handle. The shaving head is inhibited from rotation out of the rest position in a second radial direction opposite from the first radial direction U.S. Patent Application Publication 2016/0288350, published in the name of Contaldi, discloses a double-sided razor with a razor on either side of a handle. Each razor is offset from the handle at an opposite angle, with respect to a midpoint between the two razors, that midpoint also being a highest point of the handle, rising from each razor to a pinnacle in a curvilinear manner. One uses the razor by placing at least one finger on either side of the pinnacle and another under the pinnacle, such as in a concave finger region or circle, and pivots around the middle point, pushing either the one or the other razor downwards onto a surface to be shaved. Then, one switches direction and shaves in the other direction with the other razor, always or sometimes placing more pressure on the side of the device with the razor currently in use to shave or cut.

And, international Patent Application Publication WO2016/053664, published in the name of Coresh, discloses a shaving razor with one or more reciprocating blades having a handle and a shaving head with and exposed reciprocating blade. A power source is disposed within the handle with an actuator that causes at least one blade of a multi-blade razor head to reciprocate within a zone of motion. Other embodiments are also described and claimed.

In order for a safety razor to be equally adapted for universal use on any body surface, it is preferable that the blade head is capable of having an adjustable angle relative to the grasping handle. Further, adjustability of tension of a pivoting blade head would be further preferred. Consequently, a need has been felt for providing such features on a safety razor in conjunction with disposable and replaceable blade holding cartridges.

SUMMARY OF THE INVENTION

It is thus an object of the present invention to provide a safety razor having an adjustable shaving head.

It is a feature of the present invention to provide a safety razor having an angularly adjustable shaving head further including adjustable pivot tensions.

It is another feature of the present invention to provide such pivoting and tension adjustments within a handle assembly that may be adapted for use with otherwise conventional blade cartridges.

The present invention provides a safety razor having a blade head capable of having an adjustable angle relative to a grasping handle and an adjustability of tension of a pivot to the blade. The blade head is disposable and replaceable, and may be either specifically adapted or selected from commercially conventionally available blade cartridges. An adjustment mechanism for adjusting the blade head is substantially enclosed within a conduit formed within the grasping handle. The blade head is angularly adjustable between an angle >95° from a linear centerline of the handle to about 22° from the linear centerline of the handle.

According to one aspect of the present invention, the adjustable head safety razor includes a handle, a frame terminating a distal end of the handle, the frame providing a support for a razor cartridge, a tension adjustment, an angle adjustment and a blade ejection mechanism. The handle forms a generally tubular internal conduit for communication of mechanical linkages. The frame is formed of a support yoke that connects at a proximal end to a proximal terminus of the handle via the tension adjustment. An ejector bow connects an ejector linkage via a distally terminated ejector linkage adapter. A tension assembly axle is supported within the yoke by connection at a first end to a sliding tensioner linkage and at a second end to a fixed tensioner linkage. A tensioner follower is pivotally supported onto the tensioner assembly axle. A tension control linkage is linearly adjusted in a reciprocating manner by the tension adjustment knob such that the distal terminus of the tension control linkage is urged against the tension followers and the tension followers are subsequently urged against the tensioner cone assembly such as to provide a greater or lesser impingement force.

According to another aspect of the present invention, the blade assembly axle pivots via a variably adjustable spring tension. By increasing an impingement force of a tension control linkage against tension followers that include a pair of aligned spring elements that travel over an outer cone surface of a tensioner cone assembly, such spring impingement provides an adjustable angular tension to the blade cartridge. An angle adjustment uses an angle control linkage spanning between an angle adjustment knob and a blade assembly axle. The blade assembly axle is supported at a first end at a sliding blade assembly linkage and at a second end at a fixed blade assembly linkage, wherein adjustment of the angle control linkage is accomplished by a linear reciprocation as urged by an adjustment knob.

Advantages of the present invention allow for a user to customize an adjustment of the blade head concerning both shaving angle as well as the blade flex tensioning.

Additional advantages provide for all the adjustment mechanisms for manipulating blade angle and tension may be built into the reusable handle portion, rather than the disposable cartridge portion. Such an advantages allows for, inter alia, an overall more economical cost of operation.

Further objects, features, elements and advantages of the invention will become apparent in the course of the following description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the Figures. It should be understood that the legal scope of the description is defined by the words of the claims set forth at the end of this patent and that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims.

It should also be understood that, unless a term is expressly defined in this patent there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Finally, unless a claim element is defined by reciting the word "means" and a function without the recital of any structure, it is not intended that the scope of any claim element be interpreted based on the application of 35 U.S.C. § 112(f).

The best mode for carrying out the invention is presented in terms of its preferred embodiment, herein depicted within the Figures.

1. Detailed Description of the Figures

Figure 1:
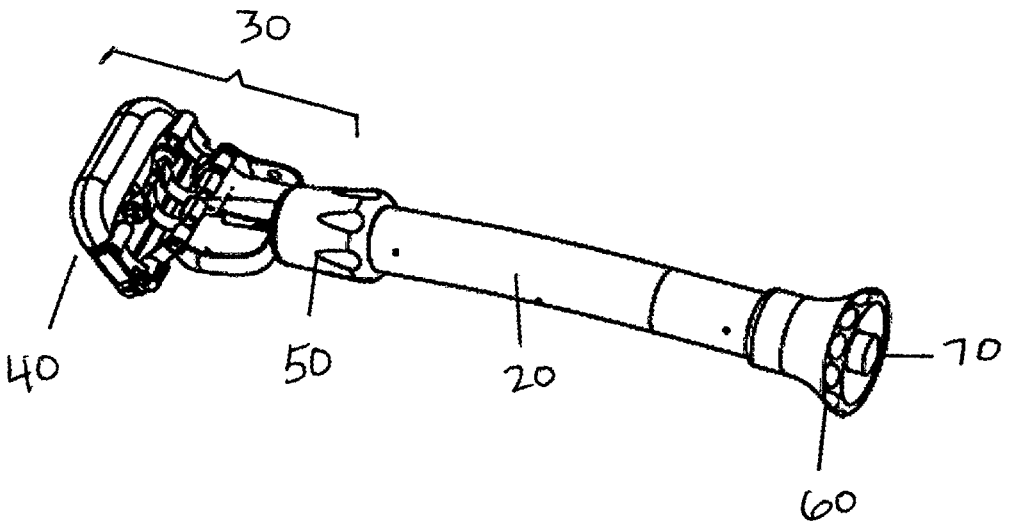
FIG. 1 is a perspective view of an adjustable head safety razor according to a preferred embodiment of the present invention.
Figure 2:
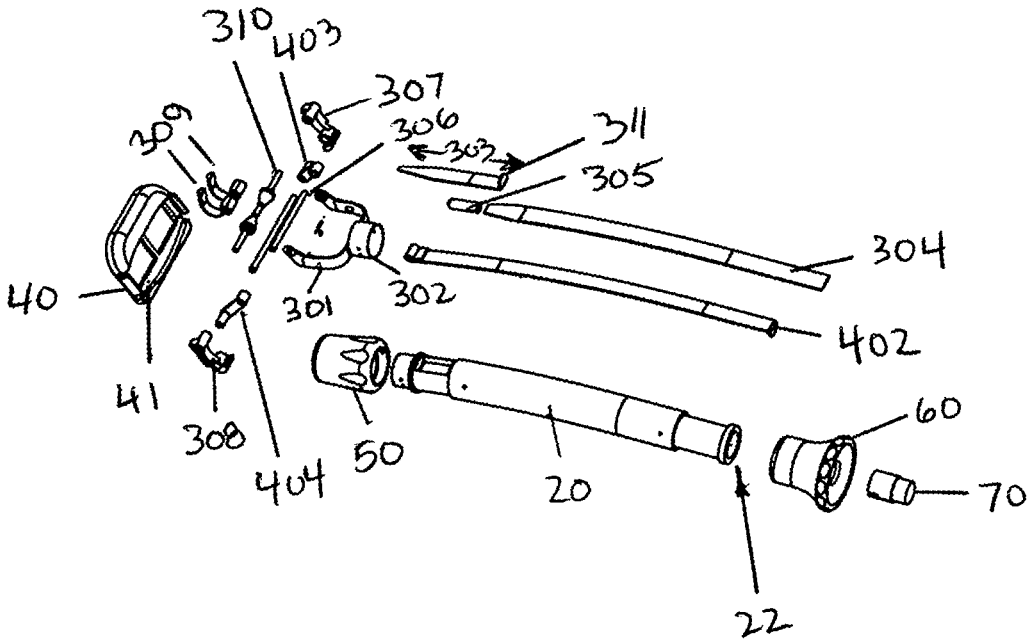
FIG. 2 is an exploded perspective view thereof.

Referring now to FIG. 1 through FIG. 2, wherein like reference numerals indicate the same parts throughout the several views, an adjustable head safety razor, generally noted as 10, is shown according to a preferred embodiment of the present invention. The safety razor 10 generally includes a handle 20, a frame 30 terminating a distal end of the handle 20, a razor cartridge 40 supported on the frame 30, a tension adjustment 50, an angle adjustment 60, and a blade ejection mechanism 70.

The handle 20 provides a generally linear elongated grasping mechanism for facilitating manual manipulation of the razor cutting surface supported at a distal terminus. The handle 20 may include various otherwise conventional grip enhancement features, including a slight curvature or surface texture or facets. The handle 20 may be generally tubular such as to provide an internal conduit 22 for communication of mechanical linkages as will be described in greater detail below.

The frame 30 may provide a support for the razor cartridge 40. The frame 30 may include a support yoke 301 that connects at a proximal end 302 to the proximal terminus of the handle 20 via the tension adjustment 50. An ejector bow 303 connects to an ejector linkage 304 via a distally terminated ejector linkage adapter 305. A tension assembly axle 306 is supported within the yoke 301 by connection at a first end to a sliding tensioner linkage 307 and at a second end to a fixed tensioner linkage 308. A tensioner follower 309 is pivotally supported onto the tensioner assembly axle 306. A tensioner cone assembly 310. A tension control linkage 311 is linearly adjusted in a reciprocating manner by tension adjustment knob 50 such that the distal terminus of the tension control linkage 311 is urged against the tension followers 309. The tension followers 309 are subsequently urged against the tensioner cone assembly 310 such as to provide a greater or lesser impingement force.

The razor cartridge 40 may be supported on a blade assembly axle 401. The razor cartridge 40 may be angularly adjustable relative to a general linear centerline of the handle 20. The razor cartridge 40 may further have pivot about the blade assembly axle 401 via a spring tension. Such spring tension may be variably adjusted. Such spring tension adjustment may be provided as described herein. The razor cartridge 40 may further be ejected so as to remove and reattach a new razor cartridge 40.

As shown, in a preferred embodiment the razor cartridge 40 may be provided in a manner that the cartridge 40 releasably affixed directly to the supporting tension/pivot assembly. However, is should be apparent to a person having ordinary skill in the relevant art, in light of the present teachings, that a connection adapter 41 may be further incorporated such as to allow the connection and use of otherwise commercially available razor cartridges to be functionally connected to and used with the pivoting, tension and release mechanisms taught herein.

As described above, the tension adjustment 50 may further comprise an adjustment knob or similar or equivalent. Tension may be adjusted essentially by increasing an impingement force of a tension control linkage 311 against tension followers 309. The tension followers 309 may include a pair of aligned spring elements 319 that travel over an outer cone surface of the tensioner cone assembly 310. Such spring impingement may provide and adjustable angular tension to the blade cartridge 40.

In addition to a primary aspect of the present invention in having an adjustable blade cartridge pivoting tension, a secondary aspect includes an adjustable angle position of the blade cartridge 40. The angle adjustment 60 may include an angle control linkage spanning between an angle adjustment knob 60 and the blade assembly axle 401. The blade assembly axle 401 may support at a first end to a sliding blade assembly linkage 403 and at a second end to a fixed blade assembly linkage 404. Adjustment of the angle control linkage 402 may be adjusted linearly in a reciprocating adjustable manner by the adjustment knob 60. As described in greater detail below, urging of the angle control linkage 402 distally will urge the razor cartridge 40 to be rotated outwardly about the blade assembly axle 401. Alternately, urging of the angle control linkage 402 proximally will urge the razor cartridge 40 to be rotated inwardly about the blade assembly axle 401.

Finally, a blade ejection mechanism 70, such as an ejection button or similar or equivalent structure, may urge the ejector linkage 304 such that the ejector linkage adapter 305 moves the ejector bow 303. Movement of the ejector bow 303 may result in urging of the yoke 301 inward and thereby result in the release of the razor cartridge 40 from the blade assembly axle 401. Ejection of the blade cartridge 40 allows for a user to remove worn blade assemblies and replace with a new blade assembly as desired.

2. Operation of the Preferred Embodiment

Figure 3:
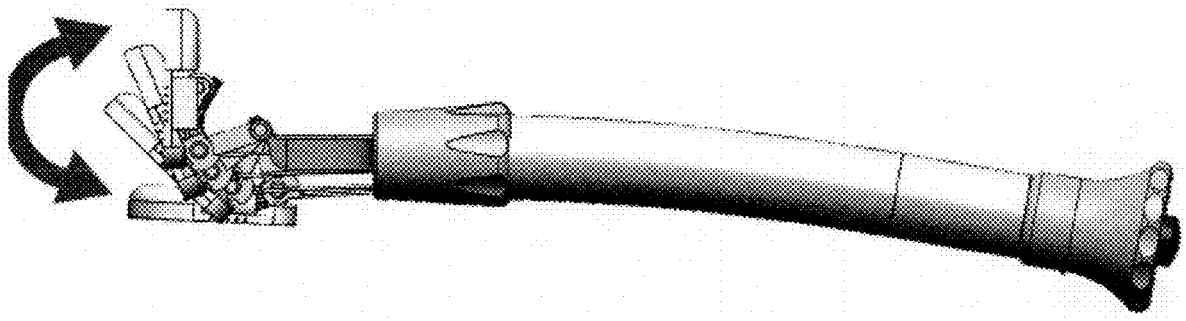
FIG. 3 is a side elevational view thereof depicting adjustability of the angle for the blade head.

In operation as best shown in conjunction with FIG. 3, the razor 10 may be used in an otherwise conventional manner but having the blade cartridge 40 configurably adjustable. The blade head 40 may adjust angularly so at to be nearly parallel to the linear centerline of the handle (i.e., >95°) to a most perpendicular angle (i.e., about 22°). A blade cartridge neutral angle may be about 45°. By manually adjusting the blade angle a user may more easily manually manipulate the shaving head in order to reach various surfaces and extremities about the body. By way of examples, and not meant as limitations, reaching to a user's legs may be better facilitated by a more parallel angle, while shaving one's face may be better facilitated by a more neutral 45° angle. Similarly, reaching one's back, head, armpits, etc. can similarly be facilitated by selection of a most desired blade head angle.

Additionally, the pivoting tension of the blade cartridge 40 may be further adjusted. Such tension adjustment at various angles may further facilitate an overall more comfortable and effective shaving experience.

The foregoing descriptions of specific embodiments of the present invention are presented for purposes of illustration and description. The Title, Background, Summary, Brief Description of the Drawings and Abstract of the disclosure are hereby incorporated into the disclosure and are provided as illustrative examples of the disclosure, not as restrictive descriptions. It is submitted with the understanding that they will not be used to limit the scope or meaning of the claims. In addition, in the Detailed Description, it can be seen that the description provides illustrative examples and the various features are grouped together in various embodiments for the purpose of streamlining the disclosure. This method of disclosure is not to be interpreted as reflecting an intention that the claimed subject matter requires more features than are expressly recited in each claim. Rather, as the following claims reflect, inventive subject matter lies in less than all features of a single disclosed configuration or operation. The following claims are hereby incorporated into the Detailed Description, with each claim standing on its own as a separately claimed subject matter.

The claims are not intended to be limited to the aspects described herein, but is to be accorded the full scope consistent with the language claims and to encompass all legal equivalents. Notwithstanding, none of the claims are intended to embrace subject matter that fails to satisfy the requirement of 35 U.S.C. § 101, 102, or 103, nor should they be interpreted in such a way. Any unintended embracement of such subject matter is hereby disclaimed. They are not intended to be exhaustive nor to limit the invention to precise forms disclosed and, obviously, many modifications and variations are possible in light of the above teaching. The embodiments are chosen and described in order to best explain principles of the invention and its practical application, to thereby enable others skilled in the art to best utilize the invention and its various embodiments with various modifications as are suited to the particular use contemplated. It is intended that a scope of the invention be defined broadly by the Drawings and Specification appended hereto and to their equivalents. Therefore, the scope of the invention is in no way to be limited only by any adverse inference under the rulings of *Warner-Jenkinson Company*, v. *Hilton Davis Chemical,* 520 U.S. 17 (1997) or *Festo Corp.* v. *Shoketsu Kinzoku Kogyo Kabushiki Co.,* 535 U.S. 722 (2002), or other similar case law or subsequent precedent should not be made if any future claims are added or amended subsequent to this Patent Application.

What is claimed includes:

1. An adjustable head safety razor comprises: comprising:
a handle;
a frame terminating a distal end of the handle, the frame providing a support for a razor cartridge;
a tension adjustment mechanism;
an angle adjustment mechanism;
a blade ejection mechanism; and
a support yoke that connects at a proximal end to a proximal terminus of the handle via the tension adjustment mechanism, and
wherein the tension adjustment mechanism further comprises:
an ejector bow connecting an ejector linkage via a distally terminated ejector linkage adapter;
a tension assembly axle supported within the yoke by connection at a first end to a sliding tensioner linkage and at a second end to a fixed tensioner linkage;
a tensioner follower pivotally supported onto the tensioner assembly axle;
a tensioner cone assembly; and
a tension control linkage linearly adjusted in a reciprocating manner by the tension adjustment knob such that the distal terminus of the tension control linkage is urged against the tension followers and the tension followers are subsequently urged against the tensioner cone assembly such as to provide a greater or lesser impingement force.

2. The adjustable head safety razor of claim 1, wherein the razor cartridge is supported on a blade assembly axle; wherein the cartridge may be angularly adjustable relative to a linear centerline of the handle.

3. An adjustable head safety razor comprising:
a handle, said handle provides a generally linear elongated grasping mechanism for facilitating manual manipulation of a razor cutting surface supported at a distal terminus;
a frame terminating a distal end of the handle, the frame providing a support for a razor cartridge;
a tension adjustment mechanism;
an angle adjustment mechanism;
a blade ejection mechanism; and
a support yoke that connects at a proximal end to a proximal terminus of the handle via the tension adjustment mechanism, and
wherein the tension adjustment mechanism further comprises:
an ejector bow connecting an ejector linkage via a distally terminated ejector linkage adapter;
a tension assembly axle supported within the yoke by connection at a first end to a sliding tensioner linkage and at a second end to a fixed tensioner linkage;
a tensioner follower pivotally supported onto the tensioner assembly axle;
a tensioner cone assembly; and
a tension control linkage linearly adjusted in a reciprocating manner by the tension adjustment knob such that the distal terminus of the tension control linkage is urged against the tension followers and the tension followers are subsequently urged against the tensioner cone assembly such as to provide a greater or lesser impingement force.

4. The adjustable head safety razor of claim 3, wherein the razor cartridge is supported on a blade assembly axle;

wherein the cartridge may be angularly adjustable relative to a linear centerline of the handle.

5. The adjustable head safety razor of claim 4, wherein the razor cartridge pivots about the blade assembly axle via a spring tension, said spring tension being variably adjusted.

6. The adjustable head safety razor of claim 5, further comprising an adjustable angle position of the blade cartridge.

7. The adjustable head safety razor of claim 6, where the angle adjustment mechanism comprises an angle control linkage spanning between an angle adjustment knob and a blade assembly axle, said blade assembly axle supported at a first end at a sliding blade assembly linkage and at a second end at a fixed blade assembly linkage, wherein adjustment of the angle control linkage is accomplished by a linear reciprocation as urged by an adjustment knob.

8. The adjustable head safety razor of claim 7, wherein the blade head is angularly adjustable between an angle >95° from a linear centerline of the handle to about 22° from the linear centerline of the handle.

9. The adjustable head safety razor of claim 4, wherein a tension is adjusted by increasing an impingement force of the tension control linkage against tension followers that include a pair of aligned spring elements that travel over an outer cone surface of a tensioner cone assembly, wherein such spring impingement provides an adjustable angular tension to the blade cartridge.

* * * * *